US007903786B2

(12) United States Patent
Zhong et al.

(10) Patent No.: US 7,903,786 B2
(45) Date of Patent: Mar. 8, 2011

(54) APPARATUS FOR INCREASING RADIATIVE HEAT TRANSFER IN AN X-RAY TUBE AND METHOD OF MAKING SAME

(75) Inventors: Dalong Zhong, Niskayuna, NY (US); Dennis M. Gray, Delanson, NY (US); Michael Hebert, Franklin, WI (US); Thomas Raber, Schenectady, NY (US); Gregory Alan Steinlage, Hartland, WI (US); Thomas C. Tiearney, Waukesha, WI (US)

(73) Assignee: General Electric Company, Niskayuna, NY (US)

( * ) Notice: Subject to any disclaimer, the term of this patent is extended or adjusted under 35 U.S.C. 154(b) by 10 days.

(21) Appl. No.: 12/197,679

(22) Filed: Aug. 25, 2008

(65) Prior Publication Data

US 2010/0046717 A1 Feb. 25, 2010

(51) Int. Cl.
*H01J 35/00* (2006.01)

(52) U.S. Cl. ..... 378/129; 378/143; 378/144

(58) Field of Classification Search ..... 378/119, 378/121–129, 143, 144
See application file for complete search history.

(56) References Cited

U.S. PATENT DOCUMENTS 4,029,828 A 6/1977 Bildstein et al.
4,132,916 A 1/1979 Hueschen et al.
4,327,305 A 4/1982 Weber
4,953,190 A 8/1990 Kukoleck et al.
4,975,621 A 12/1990 Fukubayashi et al.
5,150,397 A 9/1992 Randzaao
6,456,692 B1 9/2002 Smith
6,595,821 B2 * 7/2003 Itoh et al. ..... 445/28
6,713,774 B2 3/2004 DeSteese et al.
2004/0258916 A1 12/2004 Tului et al.

FOREIGN PATENT DOCUMENTS

EP 0567748 B1 11/1997

OTHER PUBLICATIONS

Cockeram et al., "The development and testing of emissivity enhancement coatings for themophotovoltaic (TPV) radiator applications," Thin Solid Films, 1999, pp. 17-25.

Cade, "The Thermal Emissivity of Some Materials Used in Thermionic Valve Manufacture," IRE Transactions on Electron Devices, 1961, pp. 56-69.

"ICX Photonics manufactures IR gas sensors and emitters for Industrial S . . . ," ICx Technologies, Inc., 2006, http://photonics.icxt.com/technology.shtml.

"Ultra-Intense Laser Blast Creates True 'Black Metal'," University of Rochester Press Releases, Nov. 21, 2006, http://www.rochester.edu/news/show.php?id=2701.

* cited by examiner

*Primary Examiner* — Jurie Yun
(74) *Attorney, Agent, or Firm* — Jason K. Klindtworth

(57) ABSTRACT

A target assembly for generating x-rays includes a target substrate, and an emissive coating attached to the target substrate, the emissive coating including a textured material including a plurality of granular protrusions arranged to increase gray body emissive characteristics of the target assembly above that of the target substrate.

26 Claims, 7 Drawing Sheets

APPARATUS FOR INCREASING RADIATIVE HEAT TRANSFER IN AN X-RAY TUBE AND METHOD OF MAKING SAME

BACKGROUND OF THE INVENTION

The invention relates generally to x-ray tubes and, more particularly, to a textured surface applied to anode components of an x-ray tube.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include an anode structure comprising a target onto which the electron beam impinges and from which x-rays are generated. An x-ray tube cathode provides a focused electron beam that is accelerated across a cathode-to-anode vacuum gap and produces x-rays upon impact with the anode target. Because of the high temperatures generated when the electron beam strikes the target, the anode assembly is typically rotated at high rotational speed for the purpose of distributing heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator.

Newer generation x-ray tubes have increasing demands for providing higher peak power. Higher peak power, though, results in higher peak temperatures occurring in the target assembly, particularly at the target "track," or the point of electron beam impact on the target. Thus, for increased peak power applied, there are life and reliability issues with respect to the target.

In general, radiation heat transfer may be improved by treating a surface such that its emissivity is increased. One known technique includes treating the surface by defining a dense array of cavities beneath the surface that are each exposed to the outer surface via respective small apertures that are on the order of, for example, 10 microns in diameter. In such an arrangement, the cavities behave as black bodies and may have an emissivity of essentially 1.0 over their exposed area on the surface. Thus, the overall emissivity of an original surface may be proportionately improved, and the improvement may be quantified by assuming an emissivity of 1.0 over the effective aperture areas of the cavities and by assuming that the remaining surface area, without apertures, has an emissivity equal to that of the original surface. In other words, the overall surface emissivity may be estimated by assuming that the areas of the apertures have an emissivity of 1.0 and by assuming that the remaining areas without cavities have an emissivity of the original surface. Thus, the overall emissivity may be improved by several-fold over a surface having originally a low surface emissivity.

Such a technique may, in theory, be applied to a surface of an x-ray tube target as well. However, in order to achieve the desired black body characteristics as described, typically the cavities applied to the surface have a depth-to-diameter ratio that is approximately 2:1 or greater. And, due to the unique operating environment of an x-ray tube (i.e., high temperature, high voltage, and high vacuum environment), applying such a treatment to a target may result in other negative consequences that preclude such an application therein.

For instance, cavities having a depth-to-diameter aspect ratio of 2:1 or larger on the surface of an x-ray tube target may introduce high-voltage instability problems in an x-ray tube. Because of the high depth-to-diameter ratio, the thin walls of the cavities tend to be friable, or easily fragmented, and may serve as a particulate source. Furthermore, the cavities may also serve to retain solvents or other films that may be introduced during processing of the target. Such deep cavities may act as virtual sources of contaminants, making cleaning very difficult, and possibly introducing a new long-term failure mode into the x-ray tube.

Therefore, it would be desirable to have a method and apparatus to improve the emissivity of x-ray tube target anode components while maintaining high-voltage stability of the x-ray tube in which it is operating, good mechanical integrity, and simplicity in handling.

BRIEF DESCRIPTION OF THE INVENTION

The invention provides an apparatus for improving thermal performance of an x-ray tube target that overcomes the aforementioned drawbacks.

According to one aspect of the invention, a target assembly for generating x-rays includes a target substrate, and an emissive coating attached to the target substrate, the emissive coating including a textured material including a plurality of granular protrusions arranged to increase gray body emissive characteristics of the target assembly above that of the target substrate.

In accordance with another aspect of the invention, an x-ray tube target includes a target substrate comprising one of Mo and alloys thereof, and treating a target substrate with an emissive coating comprising a plurality of protuberant granulations having an arrangement that increases a gray body emissivity from the target substrate above that of an untreated target substrate.

Yet another aspect of the invention includes an imaging system having an x-ray detector and an x-ray emission source. The x-ray source includes a cathode and an anode. The anode includes a target base material and an emissive coating attached to the target base material, the emissive coating includes a plurality of protuberant granulations configured to increase gray body emissive characteristics of the emissive coating above an emissivity of the target base material.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
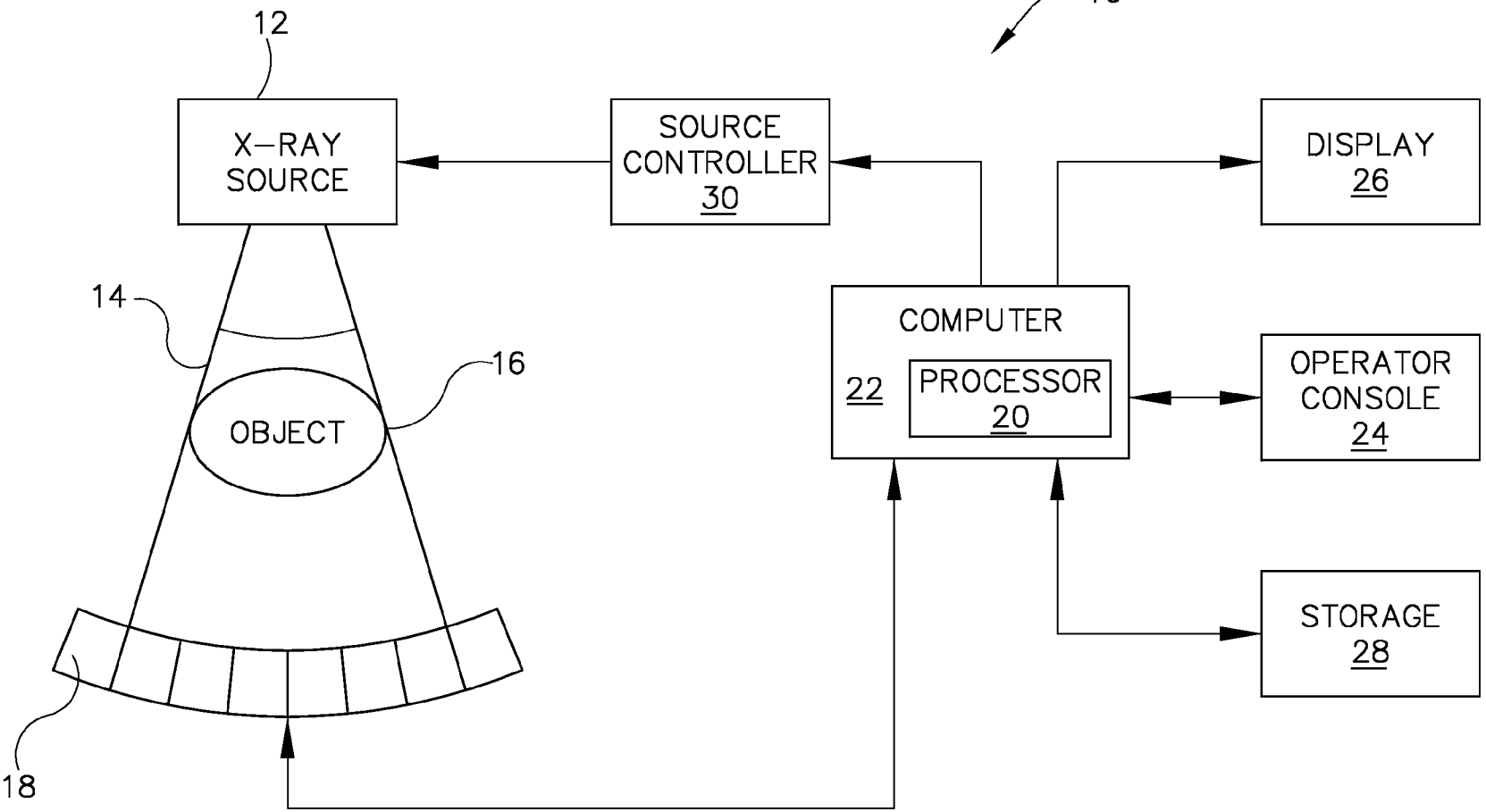
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous industrial and medical imaging systems implementing an x-ray tube, such as x-ray or mammography systems. Other imaging systems such as computed tomography systems and digital radiography systems, which acquire three-dimensional image data for a volume, also benefit from the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object 16, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12. Moreover, the invention will be described with respect to use in an x-ray tube. However, one skilled in the art will further appreciate that the invention is equally applicable for other systems that include a target used for the production of x-rays.

Figure 2:
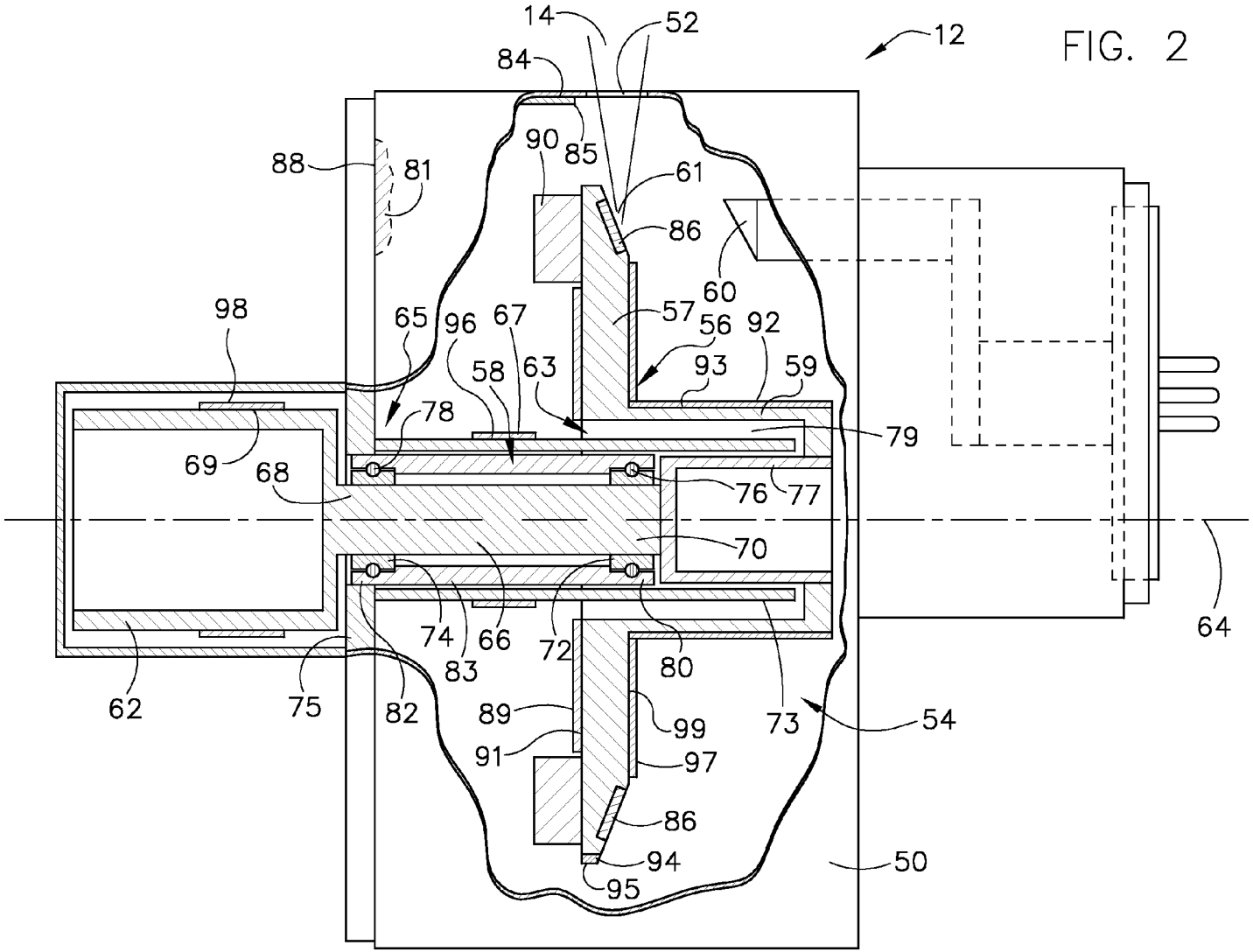
FIG. 2 is a cross-sectional view of an x-ray tube according to an embodiment of the invention and useable with the system illustrated in FIG. 1.

FIG. 2 illustrates a cross-sectional view of an x-ray tube 12 incorporating an embodiment of the invention. The x-ray tube 12 includes a frame or casing 50 having an x-ray window 52 formed therein. The frame 50 encloses a vacuum 54 and houses an anode or target assembly 56, a bearing cartridge 58, a cathode 60, and a rotor 62. The target assembly 56 includes a target substrate 57 having a target shaft 59 attached thereto. X-rays 14 are produced when high-speed electrons are decelerated when directed from the cathode 60 to the target substrate 57 via a potential difference therebetween of, for example, 60 thousand volts or more in the case of CT applications. The electrons impact a target track material 86 at focal point 61 and x-rays 14 emit therefrom. The x-rays 14 emit through the x-ray window 52 toward a detector array, such as detector 18 of FIG. 1. To avoid overheating the target track material 86 by the electrons, the target assembly 56 is rotated at a high rate of speed about a centerline 64 at, for example, 90-250 Hz.

The bearing cartridge 58 includes a front bearing assembly 63 and a rear bearing assembly 65. The bearing cartridge 58 further includes a center shaft 66 attached to the rotor 62 at a first end 68 of center shaft 66 and a bearing hub 77 attached at a second end 70 of center shaft 66. The front bearing assembly 63 includes a front inner race 72, a front outer race 80, and a plurality of front balls 76 that rollingly engage the front races 72, 80. The rear bearing assembly 65 includes a rear inner race 74, a rear outer race 82, and a plurality of rear balls 78 that rollingly engage the rear races 74, 82. Bearing cartridge 58 includes a stem 83 which is supported by the x-ray tube 12. A stator (not shown) is positioned radially external to and drives the rotor 62, which rotationally drives target assembly 56. In one embodiment, a receptor 73 is positioned to surround the stem 83 and is attached to the x-ray tube 12 at a back plate 75. The receptor 73 extends into a gap 79 formed between the target shaft 59 and the bearing hub 77.

The target track material 86 typically includes tungsten or an alloy of tungsten, and the target substrate 57 typically includes molybdenum or an alloy of molybdenum. A heat storage medium 90, such as graphite, may be used to sink and/or dissipate heat built-up near the focal point 61. One skilled in the art will recognize that the target track material 86 and the target substrate 57 may comprise the same material, which is known in the art as an all metal target.

In operation, as electrons impact focal point 61 and produce x-rays, heat generated therein causes the target substrate 57 to increase in temperature, thus causing the heat to transfer predominantly via radiative heat transfer to surrounding components such as, and primarily, frame 50. Heat generated in target substrate 57 also transfers conductively through target shaft 59 and bearing hub 77 to bearing cartridge 58 as well, leading to an increase in temperature of bearing cartridge 58.

Without an emissive coating or other anode assembly modification, target substrate 57 may have an emissivity of, for instance, 0.18. As such, radiative heat transfer from the target assembly 56 may be limited, thus contributing to an increased operating temperature of the bearing cartridge 58 and other components of the target assembly 56. Thus, to reduce conductive heat transfer into bearing cartridge 58 and to increase the amount of radiative heat transfer to the surrounding components, an emissive coating 92 may be applied to an outer surface 93 of target shaft 59. An emissive coating 97, furthermore, may be applied to surface 99 of the target substrate 57 and an emissive coating 94 may also be applied to an outer circumference 95 of the target substrate 57. Furthermore, an emissive coating 89 may be applied to the surface 91 of the target substrate 57.

Furthermore, emissive coatings may be applied to other surfaces that are encompassed within frame 50 and typically radiatively exchange heat with the target assembly 56. For instance, emissive coating 85 may be applied to frame 50 at outer circumference surface 84 or an emissive coating 81 may be applied on axial surface 88 of back plate 75. Additionally, an emissive coating 98 may be applied to surface 69 of rotor 62, or an emissive coating 67 may be applied to receptor 73 at surface 96. And, although the emissive coatings 67, 81, 85, and 98, are illustrated over only a small portion of their respective surfaces, one skilled in the art will recognize that the emissive coatings 67, 81, 85, and 98, like emissive coatings 89, 94, and 97, may be applied over the entire respective surfaces to which they are applied.

In one embodiment, the emissive coatings 67, 81, 85, 89, 94, 97, and 98 include a plurality of structures applied on their respective surfaces to enhance radiative heat transfer therefrom. Depending on the degree of enhancement desired, the surface textures can range typically from roughened surfaces to high aspect ratio cavity structures. The surface textures can be formed in the coating, in the base object, or in a bulk material that is metallurgically attached to the base object (i.e., attached via brazing, welding, and the like). Because an x-ray tube target typically operates at 1300° C. or above and because surface emissivity is a function of temperature, it is desirable to have a spectral emissivity at, for instance, 0.75 or above at a wavelength up to approximately 2000 nm.

Figure 4:
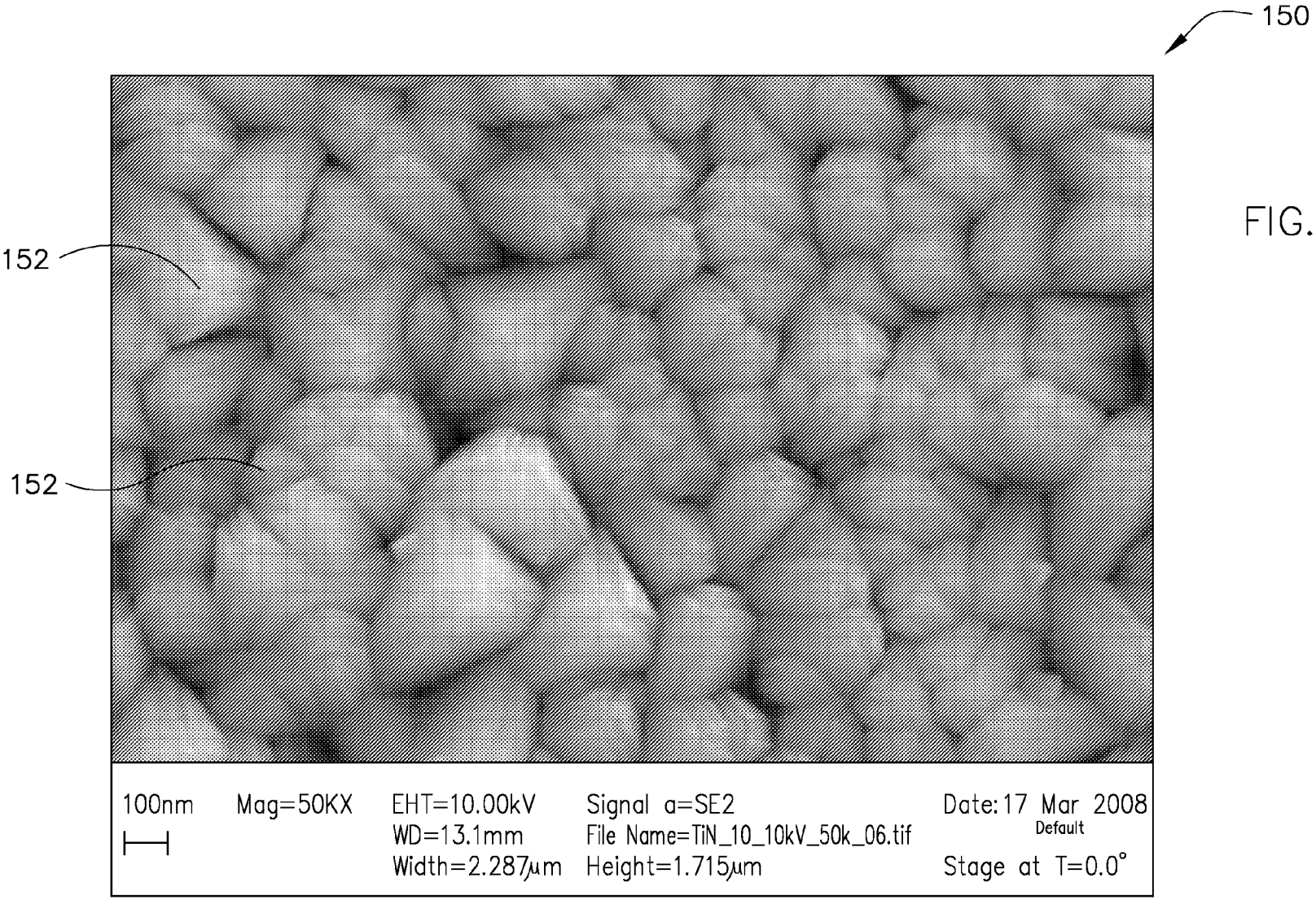
FIG. 4 is an illustration of a surface morphology formed according to an embodiment of the invention.
Figure 5:
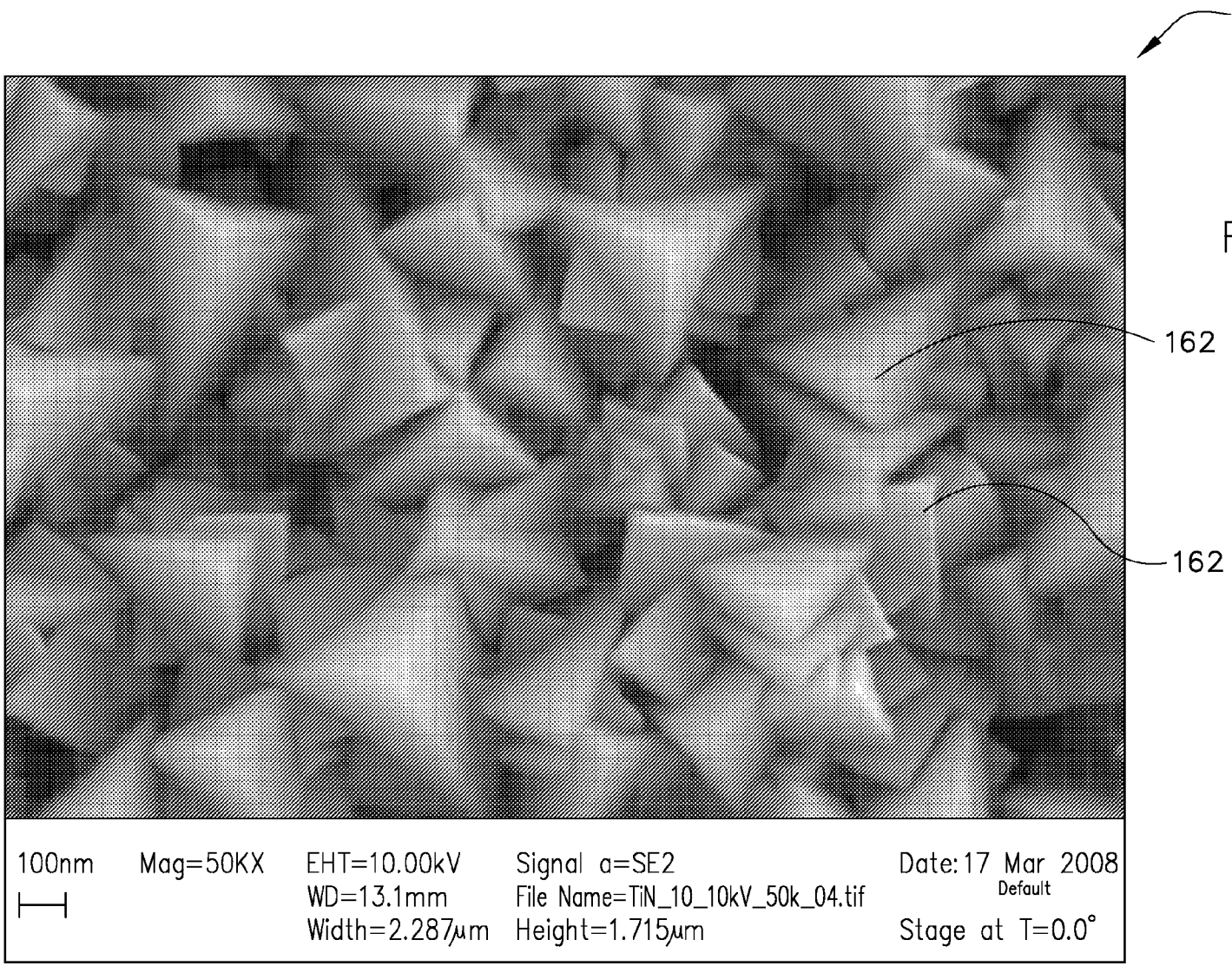
FIG. 5 is an illustration of a surface morphology formed according to an embodiment of the invention.

Surface emissivity may be increased by applying grain-like or pyramid-like surface morphologies according to embodiments of the invention. The topographical evolution of thin films and coatings may be controlled during physical vapor deposition (PVD), chemical vapor deposition (CVD), low-pressure plasma spray (LPPS), thermal spray, cold spray, reactive brazing, and cladding, as examples. The morphologies may include granular protrusions or protuberant granulations having projections in the nanometer scale as illustrated in FIGS. 4 and 5. In one embodiment, the modification of the morphology of a PVD coating can be varied by controlling the rate of vapor flux, flux ionization, substrate temperature, processing pressure, substrate bias voltage, substrate rotation rate, processing atmosphere (e.g. $Ar/N_2$ ratio for nitride coatings), and the angle between the incoming vapor flux and the substrate surface.

Figure 3:
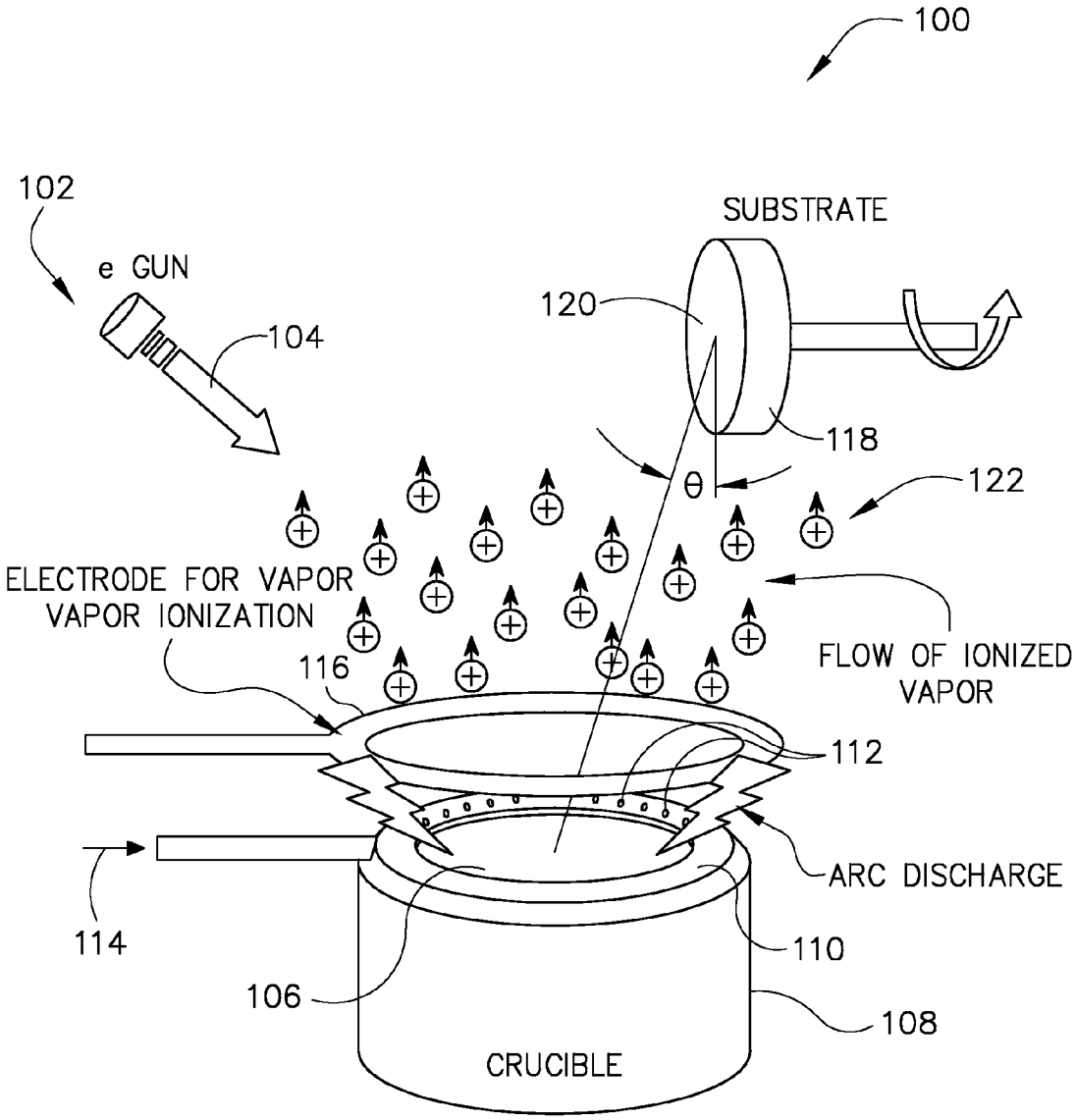
FIG. 3 is an illustration of a chamber and technique for applying a coating to a substrate according to an embodiment of the invention.

As an example, FIG. 3 illustrates a PVD chamber 100 and technique for applying an optimized high emissive coating according to an embodiment of the invention. Chamber 100 includes an electron gun 102 configured to emit an electron beam 104 toward a target 106 constructed of, for example, titanium. Target 106, having a diameter of approximately 68.5 mm, is placed into a water-cooled crucible 108. A gas distribution ring 110 having perforations 112 is positioned proximately to target 106 and is fed by a gas 114. In one embodiment, gas 114 is nitrogen, and in another embodiment, gas 114 includes a combination of nitrogen and argon. An electrode 116 is positioned proximately to target 106 between target 106 and a substrate 118. Electrode 116 is configured to discharge to target 106 when power is applied to electrode 116.

In operation, substrate 118, having a surface 120 upon which a coating is to be applied, is positioned at an angle θ with respect to target 106. In this example, the angle θ is 6°, however a range of angles between 0° and 90° may be equally applicable, depending on other combinations of settings and parameters applied during the coating process. Prior to deposition, chamber 100 is pumped to a vacuum below 1E-5 torr. Substrate 118 is rotated during the process, and nitrogen, or a mixture of nitrogen and argon, is fed into chamber 100. Electron gun 102 is configured to emit an electron beam of 0.5-0.75 A having a 18 kV accelerating voltage and scan target 106. Gas 114 is caused to flow at 1000 sccm through ring 110. The chamber pressure is maintained at approximately 3-4 mTorr. Electrode 116 is powered with approximately 100 A at 30 V. Thus, electron beam 104 vaporizes material from target 106, which emits therefrom and is ionized by discharges from electrode 116 causing a flow of ionized vapor 122 to be present in chamber 100. The ionized vapor condenses on surface 120 and forms, in this embodiment, a TiN coating thereon. During deposition, surface 120 of substrate 118 is maintained at approximately 450° C. and is maintained at an angle θ of approximately 6° with respect to target 106. Substrate 118 is biased to approximately −125 V and is rotated at approximately 10 RPM.

According to an embodiment of the invention, growth of TiN may thus be formed by: 1) evaporation of Ti from the surface of target 106, 2) ionization of Ti vapor and nitrogen by an ionization device 116, 3) formation of TiN coating at the surface 120 of substrate 118.

Thus, according to one embodiment, an optimal TiN coating is applied using chamber 100 and technique described above. However, one skilled in the art will recognize that the optimized TiN coating may be applied according to other combinations of processes, and the configuration and operating parameters described above are but one combination of conditions that will result in coatings according to embodiments of the invention. Thus, different morphology types (e.g., topography resembling pyramids, grains, ribbons, hillocks, or craters) can be produced by changing these processing conditions according to embodiments of the invention. The morphology types may be applied to the surface by randomly generating a variety of feature sizes having varying sizes and depths.

FIGS. 4 and 5 illustrate coatings that may be applied according to embodiments of the invention. Referring to FIG. 4, a granular structure 150 having nanometer scale protuberant granulations 152 that may be formed having an increased emissivity by applying TiN to the surface using the PVD process described above, according to an embodiment of the invention, but using an angle θ of 10°. However, according to this embodiment, the structure, though having an increased emissivity, is not optimized and may be further optimized by using the an angle θ of 6° as described above. Referring next to FIG. 5, an optimized coating having a granular structure 160, with granulations 162 formed thereon, may be altered from that in FIG. 4 by positioning the surface during a PVD process to receive the coating material according to the processes described above. In the illustrated embodiments, the emissivity of the surface is increased by altering the gray body characteristics thereof, and the granular sizes of the grain-like or pyramid-like surface morphologies range up to approximately 500 nm in size.

Figure 6:
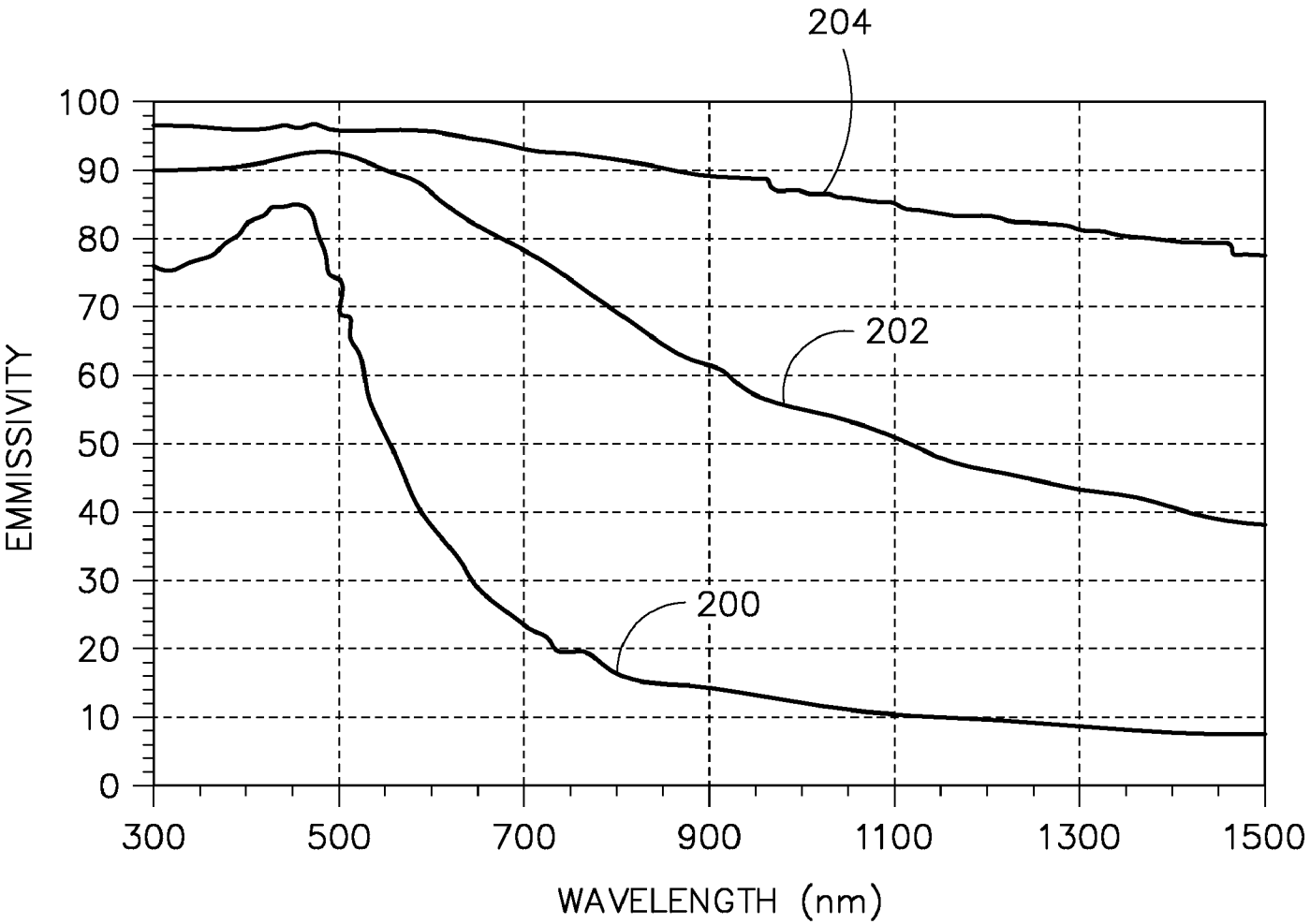
FIG. 6 is a graph showing plots illustrating emissivity measured on surfaces formed according to embodiments of the invention.

In general, assuming an opaque material, the emissivity is a function of wavelength and may be expressed as:

$$E=1-R \qquad \text{Eqn. 1,}$$

where E is the emissivity and R is the reflectivity. As such, a measure of surface reflectivity may provide a good approximation to surface emissivity. Thus, surface emissivity may be estimated, as illustrated in FIG. 6, by measuring the reflectivity and applying Eqn. 1. FIG. 6 is a graph showing plots illustrating emissivity using reflectivity data measured on surfaces formed according to embodiments of the invention. As a reference, curve 200 illustrates emissivity for a surface coating formed by positioning the surface to receive the coating material with a 90° angle and using the parameters as described above. Emissivity is increased, as compared with, for instance, the coating described with respect to curve 200, for the coating shown in FIG. 4 applied via the process described in FIG. 3 using an angle θ of 10° off of parallel (curve 202) instead of 6°. Thus, although emissivity is increased for this embodiment, the emissivity may be further increased and optimized by setting the angle to 6° off of parallel (curve 204), resulting in a corresponding increase in emissivity, and resulting in the optimized surface texture illustrated in FIG. 5. As such, using the process parameters described above, an optimized surface emissivity may be obtained by varying, for instance, the angle θ, and at 6° the process is optimized. However, as discussed, other combinations of process parameters may be applied that equally result in the optimized surface coating illustrated in FIG. 5.

Thus, referring to FIG. 6, at 1500 nm wavelength, curve 200 illustrates an emissivity of approximately 10% from the reference material, which is increased to approximately 40% for curve 202 and to 80% for curve 204. As such, by applying Eqn. 1, application of a surface structure as illustrated in FIG. 5 may result in an emissivity at 1500 nm wavelength improved from approximately 10% to 80% over emissivity of the surface without the surface structure. Note that TiN behaves differently for wavelengths below 700 nm because of its electronic band structure. Nevertheless, over all wavelengths the surface emissivity is increased. Further, although the coating illustrated in FIG. 4 is indicated to have a lower emissivity than the optimized coating illustrated in FIG. 5, that illustrated in FIG. 4 nevertheless represents a significant improvement over a non-coated surface and is, as such, considered an embodiment of the invention disclosed herein. That is, FIG. 4, like FIG. 5, illustrates a coating having a surface emissivity that is increased by applying grain-like or pyramid-like surface morphologies that include granular protrusions, or protuberant granulations, and having granular sizes ranging approximately to 500 nm in size.

Additionally, the coating applied need not be limited to TiN, but may include in general one of a nitride and a carbide. Further, the cation moiety may be any one of titanium, zirconium, hafnium, vanadium, niobium, tantalum and chromium, or a combination thereof and, when the emissive coating includes one of a nitride and a carbide, it may be applied via one of PVD and wet etching. And, although a PVD apparatus and process is described above, other apparatus and processes may be equally applicable in forming textured coatings according to this invention. For instance, sputtering, chemical vapor deposition (CVD), low-pressure plasma spray (LPPS), thermal spray, cold spray, reactive brazing, and cladding. In embodiments where the coating includes one of a nitride and a carbide, the emissive coating is deposited via one of electron beam physical vapor deposition, sputtering, and filtered arc evaporation onto the substrate, wherein the surface of the substrate has an angle of inclination between 0° and 90° to the vapor depositing source. Thus, referring as an example back to FIG. 3, in this embodiment the angle θ is 45° or less.

In an LPPS embodiment, surface emissivity may be improved, according to this embodiment, and such improvement may be quantified in terms of surface roughness. For example, textured coatings including tungsten (W), molybdenum (Mo), and alloys thereof such as Mo—TiC or Mo—ZrC, with a surface roughness greater than 9 micrometers RMS may be deposited using LPPS. Such coatings typically result in roughened granular protrusions that increase surface emissivity from that of a polished surface having typically an emissivity of 0.3, to approximately 0.7 or greater for textured surfaces with roughness of about 12 micrometers RMS.

Figure 7:
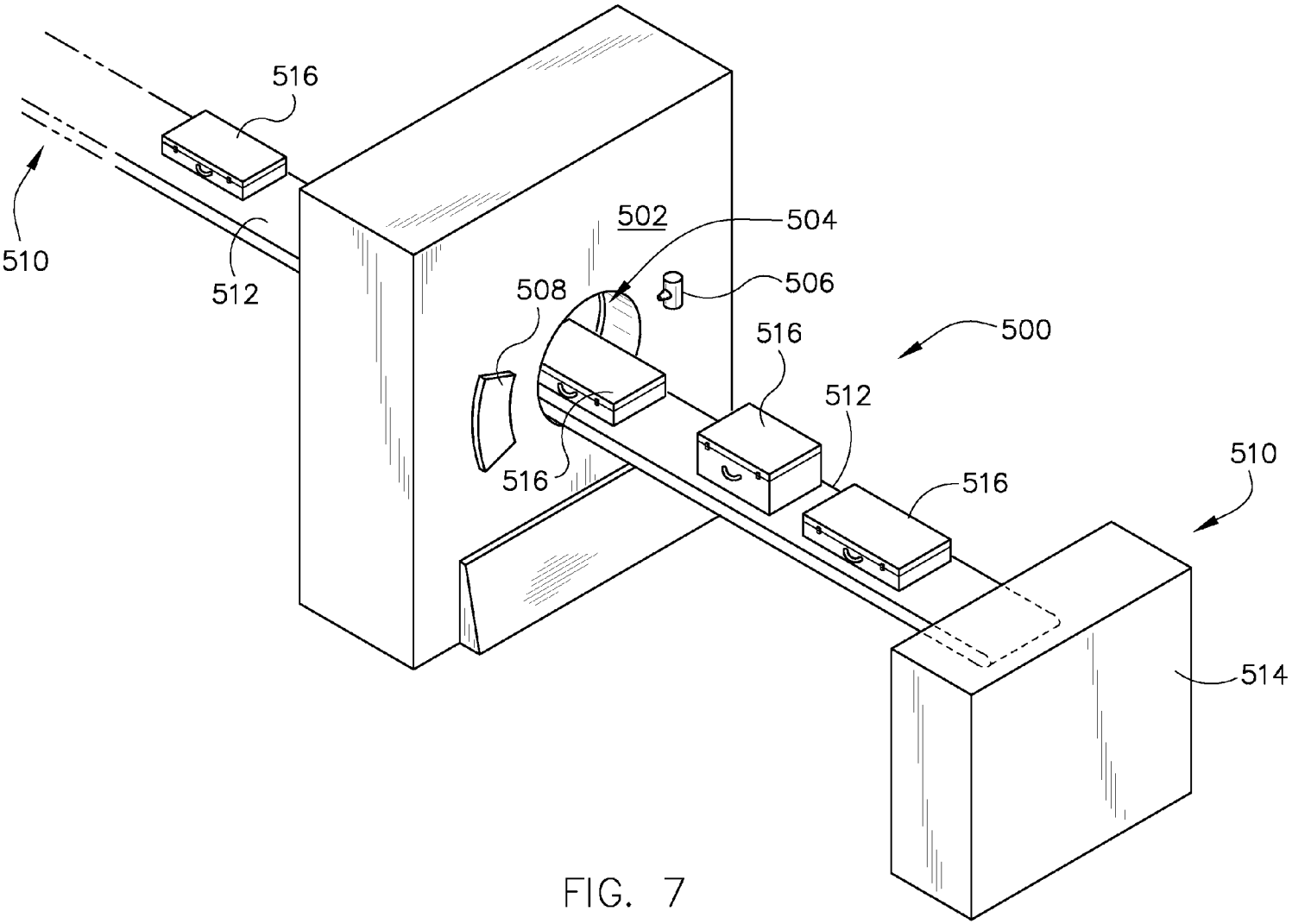
FIG. 7 is a pictorial view of a CT system for use with a non-invasive package inspection system that can benefit from incorporation of an embodiment of the invention.

FIG. 7 is a pictorial view of a CT system for use with a non-invasive package inspection system. Package/baggage inspection system 500 includes a rotatable gantry 502 having an opening 504 therein through which packages or pieces of baggage may pass. The rotatable gantry 502 houses a high frequency electromagnetic energy source 506 as well as a detector assembly 508 having scintillator arrays comprised of scintillator cells. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc.

According to one embodiment of the invention, a target assembly for generating x-rays includes a target substrate, and an emissive coating attached to the target substrate, the emissive coating including a textured material including a plurality of granular protrusions arranged to increase gray body emissive characteristics of the target assembly above that of the target substrate.

In accordance with another embodiment of the invention, an x-ray tube target includes a target substrate comprising one of Mo and alloys thereof, and treating a target substrate with an emissive coating comprising a plurality of protuberant granulations having an arrangement that increases a gray body emissivity from the target substrate above that of an untreated target substrate.

Yet another embodiment of the invention includes an imaging system having an x-ray detector and an x-ray emission source. The x-ray source includes a cathode and an anode. The anode includes a target base material and an emissive coating attached to the target base material, the emissive coating includes a plurality of protuberant granulations configured to increase gray body emissive characteristics of the emissive coating above an emissivity of the target base material.

The invention has been described in terms of the preferred embodiment, and it is recognized that equivalents, alternatives, and modifications, aside from those expressly stated, are possible and within the scope of the appending claims.

What is claimed is:

1. A target assembly for generating x-rays comprising:

a target substrate; and an emissive coating comprising one of a nitride or a carbide attached to the target substrate, the emissive coating comprising a textured material including a plurality of granular protrusions arranged to increase gray body emissive characteristics of the target assembly above that of the target substrate;

wherein the plurality of granular protrusions range in size up to approximately 500 nm.

2. The target assembly of claim 1 wherein the emissive coating further comprises one of W and Mo.

3. The target assembly of claim 2 wherein the emissive coating further comprises one of Mo—TiC or Mo—ZrC.

4. The target assembly of claim 2 wherein the emissive coating is applied via low pressure plasma spray.

5. The target assembly of claim 2 wherein a surface roughness of the emissive coating is greater than 9 micrometers RMS.

6. The target assembly of claim 1 wherein the emissive coating further comprises at least one of titanium, zirconium, vanadium, niobium, tantalum and chromium, or a combination thereof.

7. The target assembly of claim 1 wherein the emissive coating is applied via one of physical vapor deposition (PVD) and wet etching.

8. The target assembly of claim 7 wherein the emissive coating is deposited via one of electron beam physical vapor deposition, sputtering and filtered arc evaporation onto the substrate, wherein the surface of the substrate has an angle of inclination between 0° and 90° to a depositing vapor source.

9. The target assembly of claim 1 wherein the plurality of granular protrusions have a generally pyramidal shape.

10. The target assembly of claim 1 wherein the plurality of protrusions have one of a generally grain, ribbon, hillock shape or have a shape formed from a surrounding plurality of craters.

11. The target assembly of claim 1 wherein the emissive coating is applied via one of a sputtering process, a chemical vapor deposition process, a physical vapor deposition process, a low-pressure plasma spray process, a thermal spray process, a cold spray process, a reactive brazing process, and a cladding process.

12. The target assembly of claim 1 wherein the emissive coating is attached directly to the target substrate.

13. The target assembly of claim 1 further comprising a bulk material metallurgically attached to the target substrate, wherein the emissive coating is attached to the bulk material.

14. The target assembly of claim 1 further comprising a shaft attached to the target substrate, wherein the emissive coating is further attached to the shaft.

15. An x-ray tube target comprising:

a target substrate comprising one of Mo and alloys thereof; and wherein the target substrate comprises an emissive coating comprising one of a nitride or a carbide, the emissive coating comprising a plurality of protuberant granulations having an arrangement that increases a gray body emissivity from the target substrate above that of an untreated target substrate;

wherein the protuberant granulations are formed having a range of up to 500 nm in size and formed to have generally a pyramidal shape extending from a surface of the untreated target substrate.

16. The x-ray tube target of claim 15 further comprising:

metallurgically attaching a bulk material to the target substrate;

wherein the emissive coating on the target substrate is positioned on the bulk material.

17. The x-ray tube target of claim 15 wherein the emissive coating is formed having a roughness greater than 9 micrometers RMS.

18. The x-ray tube target of claim 15 wherein the emissive coating is formed via any one of a sputtering process, a chemical vapor deposition process, a physical vapor deposition process, a low-pressure plasma spray process, a thermal spray process, a cold spray process, a reactive brazing process, and a cladding process.

19. An imaging system comprising:

an x-ray detector; and an x-ray emission source having:

a cathode; and an anode, the anode comprising:

a target base material; and an emissive coating comprising one of a nitride or a carbide attached to the target base material, the emissive coating comprising a plurality of protuberant granulations configured to increase gray body emissive characteristics of the emissive coating above an emissivity of the target base material;

wherein the plurality of protuberant granulations range in size up to approximately 500 nm.

20. The imaging system of claim 19 wherein a surface roughness of the emissive coating is greater than 9 micrometers RMS.

21. The imaging system of claim 19 wherein the emissive coating further comprises one of W and Mo.

22. The imaging system of claim 19 wherein the emissive coating further comprises at least one of titanium, zirconium, vanadium, niobium, tantalum and chromium, or combination thereof.

23. A target assembly for generating x-rays comprising:

a target substrate; and an emissive coating comprising one of a nitride or a carbide attached to the target substrate, the emissive coating comprising a textured material including a plurality of granular protrusions arranged to increase gray body emissive characteristics of the target assembly above that of the target substrate;

wherein a surface roughness of the emissive coating is greater than 9 micrometers RMS.

24. A target assembly for generating x-rays comprising:

a target substrate; and an emissive coating comprising one of a nitride or a carbide attached to the target substrate, the emissive coating comprising a textured material including a plurality of granular protrusions arranged to increase gray body emissive characteristics of the target assembly above that of the target substrate;

wherein the plurality of granular protrusions have a generally pyramidal shape.

25. An x-ray tube target comprising:

a target substrate comprising one of Mo and alloys thereof; and wherein the target substrate comprises an emissive coating comprising one of a nitride or a carbide, the emissive coating comprising a plurality of protuberant granulations having an arrangement that increases a gray body emissivity from the target substrate above that of an untreated target substrate;

wherein the emissive coating is formed having a roughness greater than 9 micrometers RMS.

26. An imaging system comprising:

an x-ray detector; and an x-ray emission source having:

a cathode; and an anode, the anode comprising:

a target base material; and an emissive coating comprising one of a nitride or a carbide attached to the target base material, the emissive coating comprising a plurality of protuberant granulations configured to increase gray body emissive characteristics of the emissive coating above an emissivity of the target base material;

wherein a surface roughness of the emissive coating is greater than 9 micrometers RMS.

* * * * *